US005575463A

United States Patent [19]

Parkander

[11] Patent Number: 5,575,463

[45] Date of Patent: Nov. 19, 1996

[54] METHOD AND DEVICE FOR HANDLING SHEETS WHICH ARE PROVIDED WITH INFORMATION IN A LASER PRINTER

[75] Inventor: Göthe A. K. Parkander, Ljungby, Sweden

[73] Assignee: Stralfors AB, Ljungby, Sweden

[21] Appl. No.: 403,479

[22] Filed: Mar. 14, 1995

[30] Foreign Application Priority Data

Mar. 15, 1994 [SE] Sweden ..... 9400862

[51] Int. Cl.[6] ..... B65H 39/10; B65H 85/00

[52] U.S. Cl. ..... 270/52.02; 270/58.01; 270/58.02; 270/58.27; 271/3.05; 271/3.13; 271/176

[58] Field of Search ..... 271/3.05, 3.06, 271/3.07, 3.13, 4.02, 4.09, 201, 217, 176, 258.01; 414/788.4, 788.8, 789.9, 795.8, 797.4, 797.7; 270/52.05, 52.03, 52.04, 52.05, 52.06, 58.01, 58.02, 58.27, 52.29

[56] References Cited

U.S. PATENT DOCUMENTS

| | | | |
|---|---|---|---|
| 2,133,260 | 10/1938 | Wolff | 414/788.8 X |
| 3,051,333 | 8/1962 | Richert et al. | 271/210 X |
| 3,599,965 | 8/1971 | Humphrey et al. | 271/3.06 |
| 3,682,473 | 8/1972 | Kuyt | 271/3.13 X |
| 3,744,649 | 7/1973 | Ward, Jr. | 271/3.05 X |
| 4,034,973 | 7/1977 | Hams | 270/52.02 X |
| 4,219,191 | 8/1980 | Rastorguyeff | 271/3.07 |
| 4,296,684 | 10/1981 | Wangermann | 271/217 X |
| 4,359,218 | 11/1982 | Karis | 271/201 X |
| 4,509,739 | 4/1985 | Kurokawa | 271/176 |
| 4,555,103 | 11/1985 | Larson | 271/258.01 X |
| 4,805,890 | 2/1989 | Martin | 271/217 X |
| 4,934,687 | 6/1990 | Hayden et al. | 414/798.9 X |
| 4,968,014 | 11/1990 | Yamakoshi et al. | 271/3.06 |
| 5,088,711 | 2/1992 | Newsome | 270/58 X |
| 5,244,697 | 7/1993 | Darchis et al. | 271/201 |
| 5,253,859 | 10/1993 | Ricciardi | 271/201 X |
| 5,280,985 | 1/1994 | Meier | 270/58.29 X |
| 5,288,063 | 2/1994 | Lunt | 270/58.29 |
| 5,346,195 | 9/1994 | Heimann et al. | 270/58 X |
| 5,364,085 | 11/1994 | Kennish | 270/58.02 |
| 5,398,919 | 3/1995 | Suter | 270/58.02 |
| 5,456,573 | 10/1995 | Morris et al. | 414/788.8 X |

FOREIGN PATENT DOCUMENTS

| | | | |
|---|---|---|---|
| 2024137 | 8/1970 | France . | |
| 4012281 | 10/1991 | Germany | 414/795.8 |
| 4031587 | 11/1991 | Germany . | |
| 1277602 | 6/1972 | United Kingdom . | |

*Primary Examiner*—John Ryznic
*Attorney, Agent, or Firm*—Tarolli, Sundheim, Covell, Tummino & Szabo

[57] ABSTRACT

The present invention relates to a method and a device for handling sheets (3) which are provided with information in a laser printer (4) and fed to a sorting device (5) for being sorted. In this method, in the laser printer (4), sheets (3) provided with information are continuously fed into a magazine (12) at the top thereof while at the same time sheets (3) are continuously removed from said magazine (12) at the bottom thereof for transport to the sorting device (5), whereby sheets (3) provided with information are piled on top of each other in the magazine (12) for providing a sheet buffer supply (11) therein if the speed of the rate of the laser printer (4) to provide sheets (3) with information is higher than the speed of the rate of the sorting device (5) to sort sheets (3) received from the magazine (12), whereby the magazine (12) permits piling of a substantial number of sheets (3), e.g. 2000 sheets (3), and whereby the laser printer (4) is controlled to maintain its operating condition to provide sheets (3) with information as long as the magazine (12) contains fewer sheets (3) than the maximum number of sheets (3) which can be piled in said magazine (12).

13 Claims, 3 Drawing Sheets

METHOD AND DEVICE FOR HANDLING SHEETS WHICH ARE PROVIDED WITH INFORMATION IN A LASER PRINTER

The present invention relates to a method for handling sheets which are provided with information in a laser printer and fed to a sorting device for being sorted therewith into separate groups of sheets or into sheet piles consisting of sheet groups, whereby each sheet group contains a predetermined number of sheets and whereby the sheets are fed through the laser printer as a sheet travel consisting of separate sheets or as another sheet travel consisting of continuous sheets, which continuous sheets are divided into separate sheets in a cutting device succeeding the laser printer.

The present invention also relates to a device for carrying out said method.

At prior art methods of the abovementioned type the object is to maintain the operative condition of the data printer also when the sorting speed of the sorting device is not sufficient for delivering sheet groups with sufficient speed. Furthermore, the number of sheets in each delivered sheet group can not be increased beyond a limited number, e.g. 50 sheets in each sheet group, which limits the capacity of prior art methods. Additionally, prior art methods require voluminous devices, particularly in length.

The object of the present invention is to eliminate these limitations and provide an improved method. This is arrived at according to the invention while the method defined above has acquired the characterizing features of subsequent claim 1.

A simple device for carrying out said method is defined in subsequent claim 12.

By means of the method according to the invention, it is possible to maintain operation of the laser printer even if the sorting speed of the sorting device momentarily is insufficient for delivering sheet groups with the same speed as the sheets are produced by the laser printer. Furthermore, sheet groups with substantially more sheets in each group are obtained and that in substantially less voluminous devices than previously.

Figure 1:
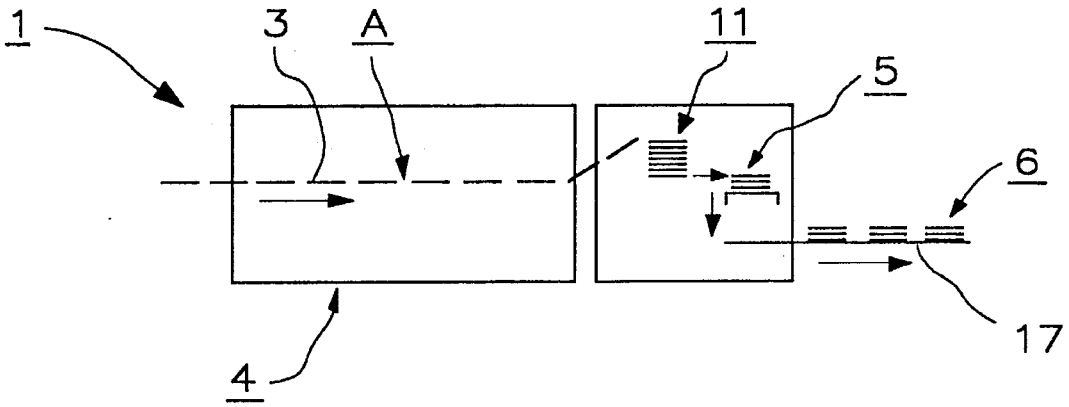
Figure 2:
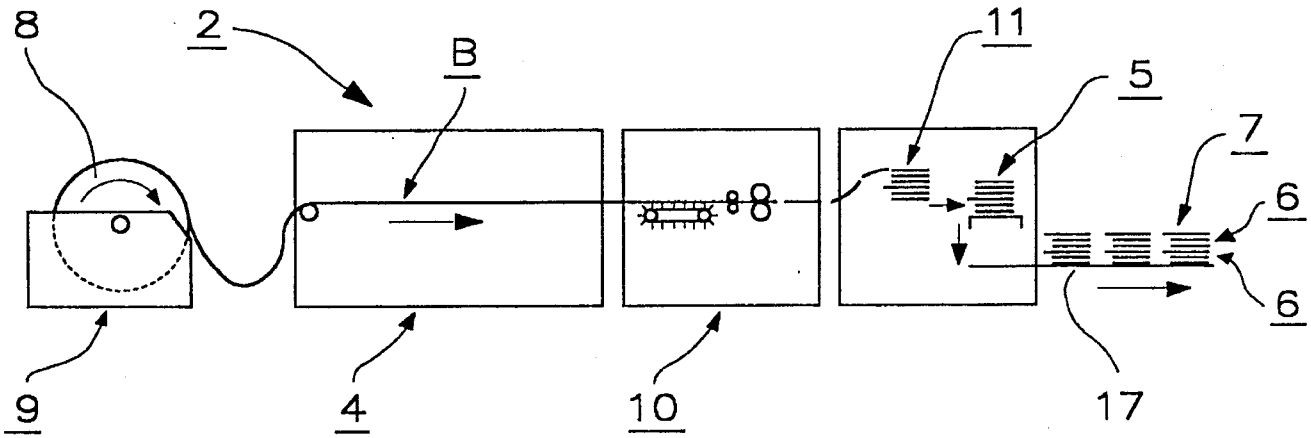
Figure 3:
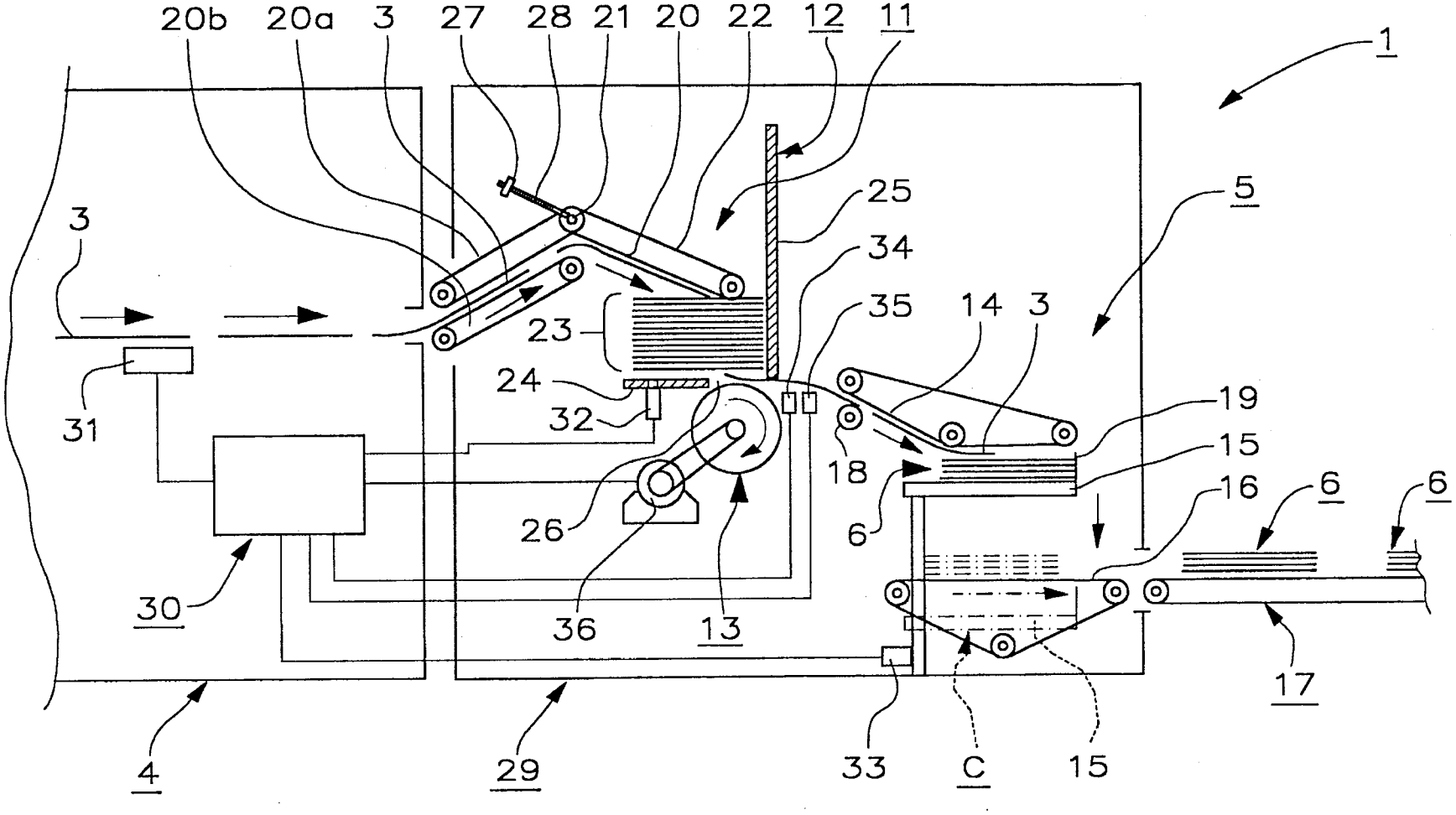
Figure 4:
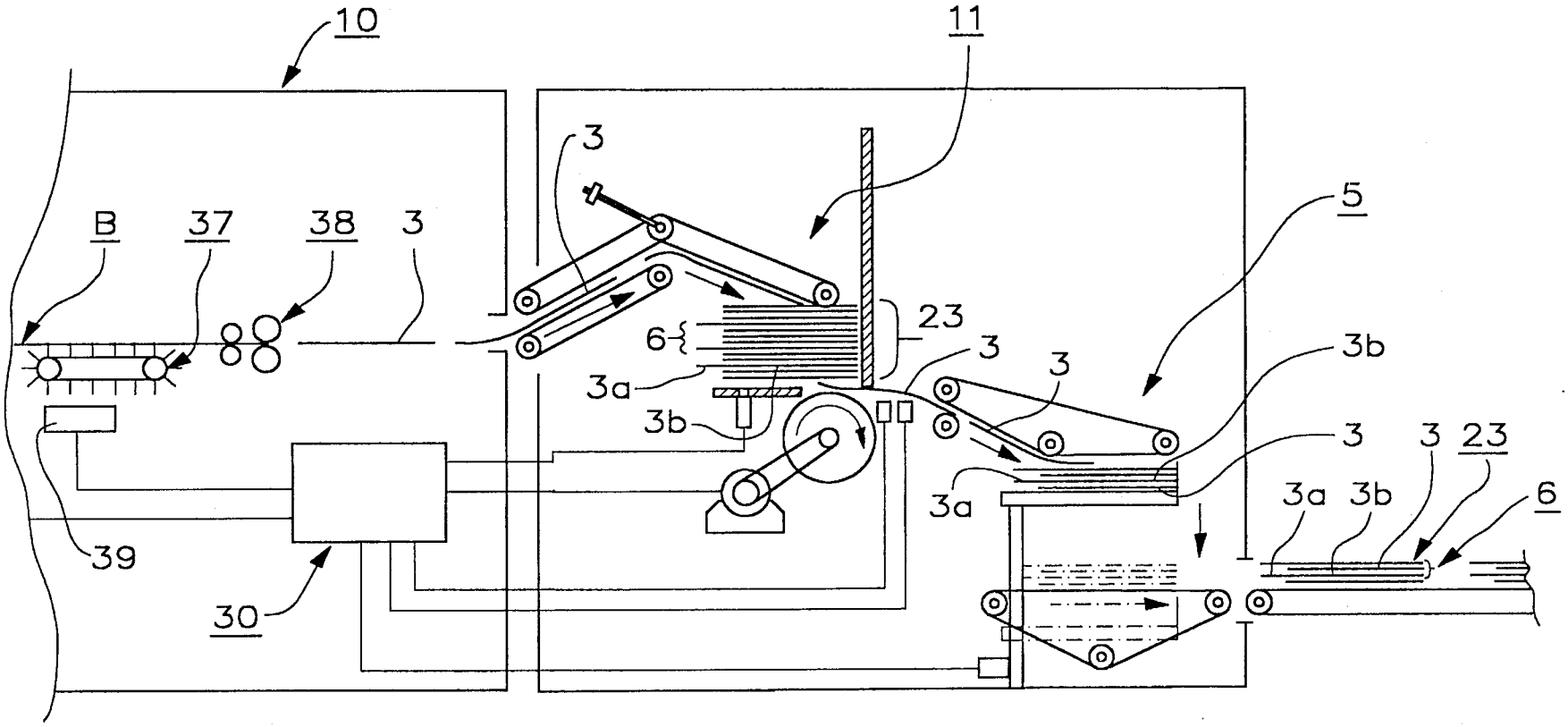

The invention will be further described below with reference to the accompanying drawings, in which FIG. 1 schematically illustrates a plant with a device for carrying through the method according to the invention, whereby said plant is adapted for laser printing on separate sheets;

FIG. 2 schematically illustrates a plant with a device for carrying through the method according to the invention, whereby said plant is adapted for laser printing on a sheet travel which after printing is cut into separate sheets;

FIG. 3 schematially and with a side view illustrates the device according to the invention forming part of the plant of FIG. 1; and FIG. 4 schematially and with a side view illustrates the device according to the invention forming part of the plant of FIG. 2.

The figures illustrate two different plants for handling sheets which are provided with information in a laser printer, i.e. a plant 1 according to FIGS. 1 and 3 and another plant 2 according to FIGS. 2 and 4.

At the plant according to FIGS. 1 and 3, a sheet travel A consisting of separate sheets 3 is fed through the laser printer 4, provided therein with the desired information and brought to a sorting device 5 for sorting by means of said device into separate sheet groups 6 or piles 7 of sheets, consisting of sheet groups 6, whereby each sheet group 6 includes a predetermined number of sheets 3.

At the plant according to FIGS. 2 and 4, a sheet travel B instead consists of continuous sheets 3 and said sheet travel B is unrolled from a roll 8 on an unwinding stand 9. The sheet travel B is provided with information in the laser printer 4 and then fed to a cutting device 10, wherein the sheet travel B is cut into separate sheets 3 which thereafter are fed to the sorting device 5.

The sheets 3 provided with information, are fed to a buffer supply 11 of sheets before said sheets are sorted into sheet groups 6 in the sorting device 5. This sheet buffer supply 11 includes a magazine 12 to the top of which the sheets 3 provided with information are continuously fed while at the same time sheets 3 are continuously removed from the magazine 12 for transfer to the sorting device 5. The magazine 12 permits piling of sheets 3 on top of each other if the speed of the rate of the laser printer 4 to provide sheets 3 with information is higher than the speed of the rate of the sorting device 5 to sort sheets 3 received from the magazine 12 into sheet groups 6 or sheet piles 7 of sheet groups 6. Furthermore, the magazine 12 is provided to permit piling of a substantial number of sheets 3, e.g. 2000 sheets 3 or about 2000 sheets 3, so that this number of piled sheets 3 is sufficient to form a larger number of sheet groups 6, e.g. 10–40 sheet groups 6, by means of the sorting device 5, which sheet groups 6 each contain a number of sheets 3, e.g. 2–50 sheets 3, which is only a small part of the number of sheets 3 that can be piled in the magazine 12, or a smaller number of sheet groups 6, e.g. 2–10 sheet groups 6, which each contain a number of sheets 3, e.g. 200–1000 sheets 3, which constitutes a large part of the number of sheets 3 that can be piled in the magazine 12. Also, the laser printer 4 is controlled by a control system 30 to maintain its operating condition to provide sheets 3 with information as long as the magazine 12 contains fewer sheets 3 than the maximum number of sheets 3 which can be piled in the magazine 12, i.e. the maximum number of sheets 3 for which the magazine 12 is adapted. Thus, the laser printer 4 can continue its operation to produce sheets 3 with information even if the sorting device 5 does not assort sheets 3 at the same rate as long as the sheet buffer supply 11 is not full.

The sheets 3 are removed from the magazine 12 at the bottom thereof by means of a removal means 13 and are brought thereby into cooperation with a transport means 14, e.g. an endless conveyor belt, located next to said removal means. By the transport means 14, the sheets 3 are transported to a sorting table 15, which forms part of the sorting device 5 and is located preferably under said transport means, and which is lowered stepwise at the same rate as sheets 3 are placed thereon, until a sheet group 6 or several sheet groups 6 containing a predetermined number of sheets 3 has/have been formed on the sorting table 15. Thereafter, the sorting table 15 is lowered to a delivery position C (shown with dashed and dotted lines in FIG. 3), wherein the sheet group 6 or sheet piles 7 consisting of several sheet groups 6 located thereon are moved out of the sorting device 5, preferably by means of a conveyor band 16 to a transport table 17 for removal of sheet groups 6 or sheet piles 7 consisting of several sheet groups 6.

The removal means 13 is preferably provided to rotate and withdraw the sheets 3 one by one from the magazine 12 by preferably adhering them by suction and holding them by suction during a part of a revolution and release them by ceasing suction so that the sheets 3 are brought into cooperation with the transport means 14.

The removal means 13 is preferably provided to feed the sheets 3 in between a support roll 18 and the transport means 14, whereafter said sheets 3 by said transport means 14 are placed on the sorting table 15 at a stop means 19 located thereon.

The removal means 13 is preferably provided to directly bring the sheets 3 into cooperation with the transport means 14 without necessarily having the sheets also to cooperate with other conveyors between the removal means 13 and the transport means 14. Hereby, a very compact unit is obtained, particularly in view of the total length of the sheet buffer supply 11 and sorting device 5 together. The sheet buffer supply 11 and the sorting device 5 can be mounted on the same stand for, inter alia, providing an easily transportable and easily connectable unit.

At the magazine 12 there is located at least one conveyor band 20 which is mounted pivotable about a horizontal axis 21. The outer part 22 of the conveyor band 20 is adapted to engage the uppermost sheet 3 in the pile 23 of sheets located in the magazine 12. The conveyor band 20 is also pivotally mounted so that it in a lowermost position can engage the bottom 24 of the magazine 12 and pivot upwards from this position as the sheet pile 23 grows until it finally reaches an uppermost position when said sheet pile 23 consists of a predetermined maximum number of sheets 3, i.e. when the sheet buffer supply 11 is filled with substantially more than 1000 sheets 3, e.g. 2000 or about 2000 sheets 3. When the number of sheets 3 in the sheet pile 23 decreases, the conveyor band 20 can follow the declining sheet pile by pivoting downwards.

Sheets 3 that are transported by conveyor bands 20*a* and 20*b* to the conveyor band 20, can be moved thereby in between its outer part 22 engaging the uppermost sheet 3 in the sheet pile 23, and said uppermost sheet 3. Hereby, the conveyor band 20 can move the sheets towards a stop means 25 so that the sheets 3 in the sheet pile 23 attain predetermined positions relative to the opening 26 in the bottom 24 of the magazine 12, and thus, to the removal means 13, through which the sheets 3 are removed or withdrawn.

For being able to vary the pressure with which the conveyor band 20 engages the sheet pile 23, said conveyor band 20 can be influenced by adjustment weights 27. These weights are preferably screwed onto a threaded rod 28 which protrudes from the axis 21 on the opposite side of that part of the conveyor band 20 which is adapted to engage the sheet pile 23.

The sheet buffer supply 11 and the sorting device 5 are preferably mounted on the same stand 29, whereby said sheet buffer supply 11 and sorting device 5 can be moved as a unit and also connected with the laser printer plant 1 or 2 as a unit.

The control system 30 of the plant 1 or 2 controls said plant for automatic operation. This control system 30 communicates preferably with a signal transmitter 31 forming part of the laser printer 4 so that said laser printer 4 provides certain sheets 3 with information regarding sheet group division. The control system 3 may also include a sheet group control means 32 which is adapted to registrate when a sheet 3 with information regarding sheet group division is the next to leave the magazine 12. The control system 30 controls the driving motor 33 of the sorting device 5, i.e. the operation of said sorting device, through a signal generated through this registration.

The control system 30 preferably also includes a control calculating means 34 which counts the number of sheets 3 removed from the magazine 12 when said sheets pass from the magazine 12 to the sorting device 5. Hereby, it is checked that said number of sheets 3 correspond with the predetermined number. Additionally, the control system 30 may include a sheet control means 35 which is adapted to control that only one sheet 3 at the time passes from the magazine 12 to the sorting device 5.

The control system 30 can also control other driving devices, e.g. the driving motor 36 of the removal means 13 and, eventually, a vacuum generating suction device forming part thereof as well as conveyor bands forming part of the plant 1 or 2 and other devices for operating the plant 1 or 2.

At the plant 2 of FIGS. 2 and 4, the cutting device 10 includes, inter alia, a feeding device 37 (a so called tractor feeder with gripping means which engage so called formaliner holes in the sheet travel B) for feeding the sheet travel B to cutting means 38 for cutting said sheet travel into separate sheets 3. Hereby, the control system 30 for controlling the plant 2 communicates with a control means 39 in the cutting device 10, and this control means 39 controls the feeding device 37 so that it feeds sheets 3*b* for sheet group division somewhat farther than other sheets 3 before they are cut off by means of the cutting means 38. Hereby, the sheet group division sheets 3*b* get a somewhat greater length than the other sheets 3 and they are located in the sheet piles 23 so that they protrude therefrom with a portion 3*a*, whereby it is easy to separate the sheet groups 6 in the sheet piles 7 from each other also visually.

The method and device according to the invention described above may vary within the scope of the following claims. Thus, the magazine 12 can be designed to that it can contain more than 2000 sheets 3, each sheet 3 can be folded or consist of several sides, the various transport means and conveyor bands may include one or more bands or be of other types of transport devices, the removal means 13 can be provided to remove and feed the sheets 3 in other ways than by suction and the magazine 12 may eventually be designed for a sheet buffer supply 11 for less than 2000 sheets 3.

I claim:

1. Method for handling sheets (3) which are provided with information in a laser printer (4) and fed to a sorting device (5) for being sorted into one or more separate sheet groups (6) containing a predetermined number of sheets (3), the sheets (3) being fed through the laser printer (4) as a sheet travel, said method comprising the steps of:

providing the sheets (3) with information;

continuously feeding the sheets (3) into a magazine (12) at the top thereof while at the same time continuously removing the sheets (3) from said magazine (12) at the bottom thereof for transport to the sorting device (5);

piling the sheets (3) on top of each other in the magazine (12) to form a sheet buffer supply (11) when the rate of the laser printer (4) providing sheets (3) with information is higher than the rate of the sorting device (5) sorting sheets (3) which are received from the magazine (12);

permitting the piling of about 2,000 sheets (3) in the magazine (12);

controlling the laser printer (4) to provide sheets (3) with information as long as the magazine (12) contains fewer sheets (3) than the maximum number of sheets (3) which can be piled in said magazine (12);

removing the sheets (3) from the magazine (12) at the bottom thereof with a removal means (13);

bringing the sheets (3) into cooperation with a transport means (14) located next to said removal means (13);

transporting the sheets (3) by the transport means (14) to a sorting table (15) which forms part of the sorting device (5) and which is located under said transport means (14); and lowering the sorting table (15) to a delivery position (C) wherein the sheets (3) located thereon are moved out of the sorting device (5) to a transport table (17) for removal.

2. Method according to claim 1. further comprising the steps of:

pulling the sheets (3) out of the magazine (12) by adherence through suction to a rotating removal means (13);

holding the sheets (3) with said suction during a part of a revolution; and releasing the sheets (3) by ceasing said suction to bring the sheets (3) into cooperation with the transport means (14).

3. Method according to claim 2, further comprising the steps of:

feeding the sheets (3) between a support roll (18) and a transport means (14) by rotating the removal means (13), said removal means (13) comprising a conveyor band (16); and placing the sheets (3) on the sorting table (15) at a stop means (19) with said conveyor band (16).

4. Method according to claim 1, further comprising the step of bringing the sheets (3) into cooperation with the transport means (14) without other conveyors between said removal means (13) and said transport means (14).

5. Method for handling sheets (3) which are provided with information in a laser printer (4) and fed to a sorting device (5) for being sorted into one or more separate sheet groups (6) containing a predetermined number of sheets (3), the sheets (3) being fed through the laser printer (4) as a sheet travel, said method comprising the steps of:

providing the sheets (3) with information;

continuously feeding the sheets (3) into a magazine (12) at the top thereof while at the same time continuously removing the sheets (3) from said magazine (12) at the bottom thereof for transport to the sorting device (5);

piling the sheets (3) on top of each other in the magazine (12) to form a sheet buffer supply (11) when the rate of the laser printer (4) providing sheets (3) with information is higher than the rate of the sorting device (5) sorting sheets (3) which are received from the magazine (12);

permitting the piling of about 2,000 sheets (3) in the magazine (12);

controlling the laser printer (4) to provide sheets (3) with information as long as the magazine (12) contains fewer sheets (3) than the maximum number of sheets (3) which can be piled in said magazine (12);

checking the number of sheets (3) which are removed from the magazine (12) when said sheets (3) pass from said magazine (12) to the sorting device (5); and checking to see that only one sheet (3) at a time is fed from the magazine (12) to the sorting device (5).

6. Method for handling sheets (3) which are provided with information in a laser printer (4) and fed to a sorting device (5) for being sorted into one or more separate sheet groups (6) containing a predetermined number of sheets (3), the sheets (3) being fed through the laser printer (4) as a sheet travel, said method comprising the steps of:

providing the sheets (3) with information;

continuously feeding the sheets (3) into a magazine (12) at the top thereof while at the same time continuously removing the sheets (3) from said magazine (12) at the bottom thereof for transport to the sorting device (5);

piling the sheets (3) on top of each other in the magazine (12) to form a sheet buffer supply (11) when the rate of the laser printer (4) providing sheets (3) with information is higher than the rate of the sorting device (5) sorting sheets (3) which are received from the magazine (12);

permitting the piling of about 2,000 sheets (3) in the magazine (12);

controlling the laser printer (4) to provide sheets (3) with information as long as the magazine (12) contains fewer sheets (3) than the maximum number of sheets (3) which can be piled in said magazine (12);

registering when a sheet (3) with information regarding sheet group division will be next to leave the magazine (12); and controlling the sorting device (5) with a signal which is generated because of the registration.

7. Method for handling sheets (3) which are provided with information in a laser printer (4) and fed to a sorting device (5) for being sorted into one or more separate sheet groups (6) containing a predetermined number of sheets (3), the sheets (3) being fed through the laser printer (4) as a sheet travel, said method comprising the steps of:

providing the sheets (3) with information;

continuously feeding the sheets (3) into a magazine (12) at the top thereof while at the same time continuously removing the sheets (3) from said magazine (12) at the bottom thereof for transport to the sorting device (5);

piling the sheets (3) on top of each other in the magazine (12) to form a sheet buffer supply (11) when the rate of the laser printer (4) providing sheets (3) with information is higher than the rate of the sorting device (5) sorting sheets (3) which are received from the magazine (12);

permitting the piling of about 2,000 sheets (3) in the magazine (12);

controlling the laser printer (4) to provide sheets (3) with information as long as the magazine (12) contains fewer sheets (3) than the maximum number of sheets (3) which can be piled in said magazine (12);

locating at least one pivotally mounted conveyor band (20) with an outer part (22) thereof for engaging an uppermost sheet (3) in a sheet pile (23) in the magazine (12);

placing sheets (3) in the magazine (12) on top of said uppermost sheet (3) in the sheet pile (23);

feeding the sheets (3) with the conveyor band (20) between said uppermost sheet (3) and said outer part (22) of said conveyor band (20);

feeding the sheets (3) with conveyor band (20) towards a stop means (25) to ensure that the sheets (3) in the magazine (12) attain predetermined positions relative to a removal means (13) for removal thereof from the magazine (12);

pivoting the conveyor band (20) upward to insert sheets (3) into a growing pile (23) of sheets (3) in the magazine (12);

pivoting the conveyor band (20) downward when the sheet pile (23) shrinks; and adjusting the engagement pressure of the pivotally mounted conveyor band (20) with which said conveyor band (20) engages the sheet pile (23) in the magazine (12) using adjustment weights (27).

8. Apparatus for handling sheets (3) which are provided with information in a laser printer (4) and fed to a sorting device (5) for being sorted into one or more separate groups (6) containing a predetermined number of sheets (3), the sheets (3) being fed through the laser printer (4) as a sheet travel, the apparatus comprising:

a magazine (12), the top of said magazine (12) being continuously fed with sheets (3) which are provided with information while at the same time sheets (3) are continuously being removed from the magazine (12) for transport to the sorting device (5);

said magazine (12) forming a sheet buffer supply (11) by permitting piling of sheets (3) on top of each other when the rate of the laser printer (4) providing sheets (3) with information is higher than the rate of the sorting device (5) sorting sheets (3) which are received from the magazine (13);

said magazine (12) permitting piling of about 2,000 sheets (3);

the laser printer (4) being controlled by a control system (30) to provide sheets (3) with information as long as the magazine (12) contains fewer sheets (3) than the maximum number of sheets (3) which can be piled in said magazine (12); and a removal means (13) for removing the sheets (3) from the bottom of the magazine (12) and for bringing said sheets into cooperation with a transport means (14) located next to said removal means (13);

said transport means (14) transporting the sheets (3) to a sorting table (15) which forms part of the sorting device (5) and which is located under said transport means (14);

the sorting table (15) being lowered stepwise at the same rate that the sheets (3) are placed thereon until a sheet group (6) containing a predetermined number of sheets (3) is formed on the sorting table (15);

the sorting table (15) thereafter being lowerable to a delivery position (C) wherein the sheet group (6) located on said table (15) is moved out of the sorting device (5) to a transport table (17) for removal.

9. Apparatus according to claim 8, wherein the removal means (13) removes the sheets (3) from the magazine (12) by adhering said sheets (3) through suction, said suction holding said sheets (3) for a part of a revolution and then releasing the sheet (3) by ceasing said suction to bring the sheets (3) into cooperation with the transport means (14).

10. Apparatus according to claim 9, wherein the removal means (13) feeds the sheets (3) between a support roll (18) and a transport means (14), the removal means comprising a conveyor band which places the sheets (3) on the sorting table (15) at a stop means (19).

11. Apparatus for handling sheets (3) which are provided with information in a laser printer (4) and fed to a sorting device (5) for being sorted into one or more separate groups (6) containing a predetermined number of sheets (3), the sheets (3) being fed through the laser printer (4) as a sheet travel, the apparatus comprising:

a magazine (12), the top of said magazine (12) being continuously fed with sheets (3) which are provided with information while at the same time sheets (3) are continuously being removed from the magazine (12) for transport to the sorting device (5);

said magazine (12) forming a sheet buffer supply (11) by permitting piling of sheets (3) on top of each other when the rate of the laser printer (4) providing sheets (3) with information is higher than the rate of the sorting device (5) sorting sheets (3) which are received from the magazine (23);

said magazine (12) permitting piling of about 2,000 sheets (3);

the laser printer (4) being controlled by a control system (30) to provide sheets (3) with information as long as the magazine (12) contains fewer sheets (3) than the maximum number of sheets (3) which can be piled in said magazine (12);

a control calculating means (34) for checking the number of sheets (3) removed from the magazine (12) when said sheets (3) pass from said magazine (12) to the sorting device (5); and a sheet control means (35) for checking to see that only one sheet (3) at a time is fed from the magazine (12) to the sorting device (5).

12. Apparatus for handling sheets (3) which are provided with information in a laser printer (4) and fed to a sorting device (5) for being sorted into one or more separate groups (6) containing a predetermined number of sheets (3), the sheets (3) being fed through the laser printer (4) as a sheet travel, the apparatus comprising:

a magazine (12), the top of said magazine (12) being continuously fed with sheets (3) which are provided with information while at the same time sheets (3) are continuously being removed from the magazine (12) for transport to the sorting device (5);

said magazine (12) forming a sheet buffer supply (11) by permitting piling of sheets (3) on top of each other when the rate of the laser printer (4) providing sheets (3) with information is higher than the rate of the sorting device (5) sorting sheets (3) which are received from the magazine (13);

said magazine (12) permitting piling of about 2,000 sheets (3);

the laser printer (4) being controlled by a control system (30) to provide sheets (3) with information as long as the magazine (12) contains fewer sheets (3) than the maximum number of sheets (3) which can be piled in said magazine (12); and a sheet group control means (32) for checking the magazine (12) for registration of a sheet (3) with information regarding sheet group division, the sorting device (5) being controlled by a signal generated through the registration.

13. Apparatus for handling sheets (3) which are provided with information in a laser printer (4) and fed to a sorting device (5) for being sorted into one or more separate groups (6) containing a predetermined number of sheets (3), the sheets (3) being fed through the laser printer (4) as a sheet travel, the apparatus comprising:

a magazine (12), the top of said magazine (12) being continuously fed with sheets (3) which are provided with information while at the same time sheets (3) are continuously being removed from the magazine (12) for transport to the sorting device (5);

said magazine (12) forming a sheet buffer supply (11) by permitting piling of sheets (3) on top of each other when the rate of the laser printer (4) providing sheets (3) with information is higher than the rate of the sorting device (5) sorting sheets (3) which are received from the magazine (13);

said magazine (12) permitting piling of about 2,000 sheets (3);

the laser printer (4) being controlled by a control system (30) to provide sheets (3) with information as long as the magazine (12) contains fewer sheets (3) than the maximum number of sheets (3) which can be piled in said magazine (12); and at least one pivotally mounted conveyor band (20) having an outer part (22) for engaging an uppermost sheet (3) in a sheet pile (23) in the magazine (12);

the conveyor band (20) placing the sheets (3) on top of said uppermost sheet (3) in the sheet pile (23) by feeding said sheets between said uppermost sheet (3) and said outer part (22) of said conveyor band (20);

the conveyor band (20) feeding the sheets (3) towards a stop means (25) to ensure that the sheets (3) in the magazine (12) attain predetermined positions relative to a removal means (13) for removal thereof from the magazine (12); and said conveyor band (20) engaging the sheet pile (23) in the magazine (12) with an engagement pressure which is adjustable by means of adjustment weights (27) provided on a first side of an axis (21), said outer part (22) of said conveyor band (20) which engages the sheet pile (23) being located on an opposing second side of said axis (21).

* * * * *